US008146316B2

(12) United States Patent
Boss et al.

(10) Patent No.: US 8,146,316 B2
(45) Date of Patent: Apr. 3, 2012

(54) ELECTRIFIED CEILING GRID

(75) Inventors: Daniel Boss, Lake Villa, IL (US); Ying (Lora) Liang, Vernon Hill, IL (US)

(73) Assignee: USG Interiors, LLC, Chicago, IL (US)

( * ) Notice: Subject to any disclaimer, the term of this patent is extended or adjusted under 35 U.S.C. 154(b) by 217 days.

(21) Appl. No.: 12/582,790

(22) Filed: Oct. 21, 2009

(65) Prior Publication Data

US 2010/0126104 A1 May 27, 2010

Related U.S. Application Data

(60) Provisional application No. 61/118,058, filed on Nov. 26, 2008.

(51) Int. Cl.
*E04B 2/00* (2006.01)

(52) U.S. Cl. ..... 52/506.07; 52/220.6

(58) Field of Classification Search ..... 52/506.07, 52/220.6, 506.04, 506.06, 489.1, 506.09, 52/506.08, 506.1, 489.2; 439/94, 716, 532
See application file for complete search history.

(56) References Cited

U.S. PATENT DOCUMENTS

| | | | | |
|---|---|---|---|---|
| 3,146,956 | A | | 9/1964 | Schwartz et al. |
| 3,559,146 | A | | 1/1971 | Vantonen |
| 3,590,135 | A | | 6/1971 | Herbenar et al. |
| 3,649,741 | A | | 3/1972 | Fremont |
| 3,683,101 | A | | 8/1972 | Liberman |
| 3,710,530 | A | | 1/1973 | Valtonen |
| 3,725,568 | A | | 4/1973 | Stanley |
| 3,781,567 | A | | 12/1973 | Papsco |
| 3,898,782 | A | | 8/1975 | Donato |
| 3,918,224 | A | | 11/1975 | Sundequist |
| 3,919,457 | A | | 11/1975 | Steiner |
| 4,414,617 | A | | 11/1983 | Galindo |
| 4,420,798 | A | | 12/1983 | Herst et al. |
| 4,540,847 | A | | 9/1985 | Gardner |
| 4,631,648 | A | | 12/1986 | Nilssen |
| 5,325,647 | A | * | 7/1994 | Forry et al. ..... 52/309.15 |
| 5,342,204 | A | | 8/1994 | Och |
| 5,390,461 | A | | 2/1995 | Dwyer |
| 5,803,755 | A | | 9/1998 | Kuchar et al. |
| 5,868,489 | A | | 2/1999 | Fuller et al. |
| 6,033,097 | A | | 3/2000 | Harwood |
| 6,527,406 | B1 | | 3/2003 | Slesinger et al. |
| 6,540,372 | B2 | | 4/2003 | Joseph |
| 6,722,918 | B2 | | 4/2004 | McCoy |
| 7,351,075 | B1 | | 4/2008 | Patterson et al. |

(Continued)

FOREIGN PATENT DOCUMENTS

JP 2004036138 A 2/2004

OTHER PUBLICATIONS

International Search Report, PCT/US2009/061602, dated May 24, 2010.

*Primary Examiner* — Branon Painter
(74) *Attorney, Agent, or Firm* — Pearne & Gordon LLP

(57) ABSTRACT

An elongated grid tee for supplying low voltage power on a suspended ceiling comprising at least two electrically conductive paths electrically insulated from each other, extending lengthwise of the tee, and accessible for receiving or supplying electrical power at numerous locations along the length of the tee.

5 Claims, 5 Drawing Sheets

U.S. PATENT DOCUMENTS

| | | | | |
|---|---|---|---|---|
| 7,661,229 | B2 * | 2/2010 | Frecska et al. | 52/220.6 |
| 2002/0109984 | A1 | 8/2002 | Bischel et al. | |
| 2003/0021116 | A1 | 1/2003 | Miller et al. | |
| 2007/0103824 | A1 | 5/2007 | Patterson et al. | |
| 2008/0087464 | A1 | 4/2008 | Patterson et al. | |
| 2008/0090431 | A1 | 4/2008 | Patterson et al. | |
| 2008/0090432 | A1 | 4/2008 | Patterson et al. | |
| 2008/0155915 | A1 | 7/2008 | Howe et al. | |
| 2008/0197702 | A1 | 8/2008 | Banach | |
| 2010/0126105 | A1 * | 5/2010 | Boss | 52/664 |
| 2010/0132281 | A1 * | 6/2010 | Frecska et al. | 52/220.6 |
| 2010/0139190 | A1 * | 6/2010 | Lehane et al. | 52/220.6 |

* cited by examiner

ELECTRIFIED CEILING GRID

This application claims the priority of U.S. Provisional Application No. 61/118,058, filed Nov. 26, 2008.

BACKGROUND OF THE INVENTION

The invention relates to suspended ceiling structures and, in particular, to electrification of such ceiling structures.

PRIOR ART

Commercial building spaces such as offices, laboratories, light manufacturing facilities, health facilities, meeting and banquet hall facilities, educational facilities, common areas in hotels, apartments, retirement homes, retail stores, restaurants and the like are commonly constructed with suspended ceilings. These suspended ceiling installations are ubiquitous, owing to their many recognized benefits. Such ceilings ordinarily comprise a rectangular open grid suspended by wire from a superstructure and tile or panels carried by the grid and enclosing the open spaces between the grid elements. The most common form of grid elements has an inverted T-shaped cross-section. The T-shape often includes a hollow bulb at the top of the inverted stem of the T-shape. A popular variant of this standard T-shape includes a downwardly open C-shaped channel formed by the lower part of the inverted tee.

Advances in electronics has fed further advances and led the world into the digital age. This digital movement creates an ever-increasing demand for low voltage direct current (DC) electrical power. This demand would seem to be at least as great in finished commercial space as any other occupied environment. A conventional suspended ceiling has potential to be an ideal structure for distributing low voltage electrical power in finished spaced. Many relatively low power devices are now supported on such ceilings and newer electronic devices and appliances are continuously being developed and adopted for mounting on ceilings.

The ceiling structure, of course, typically overlies the entire floor space of an occupiable area. This allows the ceiling to support electronic devices where they are needed in the occupied space. Buildings are becoming more intelligent in energy management of space conditioning, lighting, noise control, security, and other applications. The appliances that provide these features, including sensors, actuators, transducers, speakers, cameras, and recorders, in general, all utilize low voltage DC power.

As the use of electronics grows, the consumption of low voltage electrical power likewise grows. This seemingly ever accelerating appetite for DC power presents opportunities for more efficient transformation of relatively high voltage utility power typically found at 110/115 or 220/240 alternating current (AC) volts with which the typical enclosed space is provided. Individual power supplies located at the site of or integrated in an electronic device, the most frequent arrangements today, are often quite inefficient in transforming the relatively high voltage AC utility power to a lower DC voltage required by an electronic device. Typically, they can consume appreciable electric power in a standby mode when the associated electronic device is shut off. It is envisioned that a single DC power source serving the electronic needs of a building or a single floor of a building can be designed to be inherently more efficient since its cost is distributed over all of the devices it serves and because it can take advantage of load averaging strategies.

SUMMARY OF THE INVENTION

The invention permits and augments the practical and versatile use of the grid elements of a conventional style suspended ceiling to supply and distribute low voltage electrical power to the area of a building with which it is associated. In accordance with the invention, a grid runner or tee of generally conventional cross-sectional shape is employed as a rigid carrier for one or more pair of conductors or as a conductor or conductors itself.

As disclosed, the conductors can be conductive inks, metal foils, metal tapes, metal wires, or the components of a grid tee or combinations of these elements. A conductor, where it is distinct from the structure of a tee itself, can be located along various surfaces of a tee either in symmetrical or non-symmetrical relation to a central vertical plane of symmetry of the tee. In numerous disclosed embodiments, a conductor can be economically formed in situ as an ink trace deposited on the structure of a tee. This ink trace can be formed before or after a tee is roll-formed into a finished shape from a sheet metal strip. Similarly, a conductive foil, tape, or wire can be fixed onto the strip stock or formed tee.

DESCRIPTION OF THE PREFERRED EMBODIMENTS

Figure 4A:
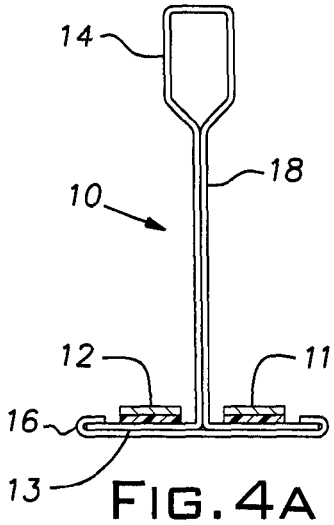
FIGS. 4A-4E are grid tee cross-sections with discrete electrical conductors symmetrically arranged on opposite sides of a central vertical plane.
Figure 4B:
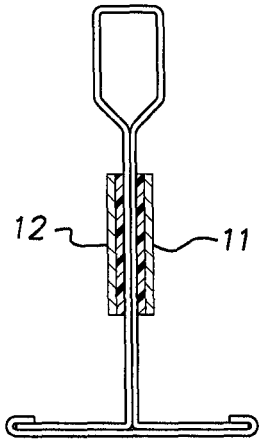
Figure 4C:
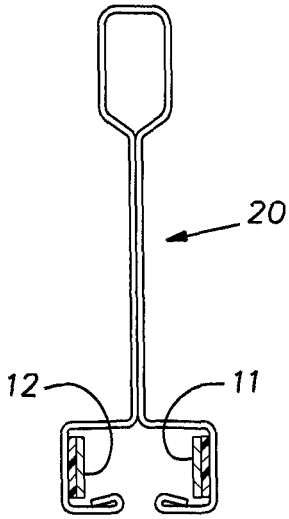
Figure 4D:
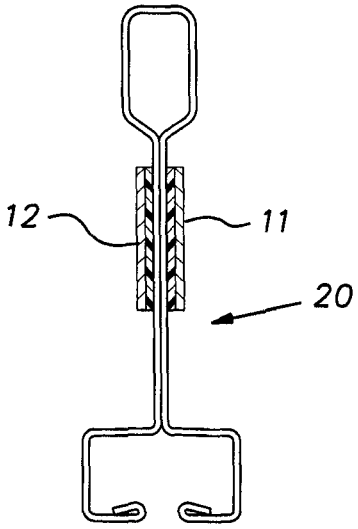
Figure 4E:
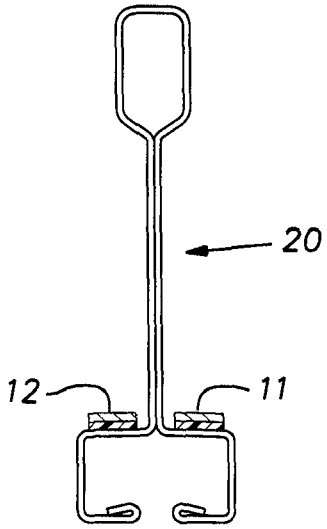
Figure 5A:
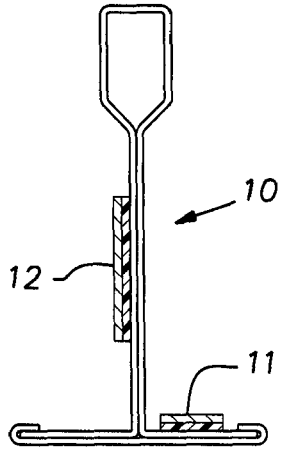
FIGS. 5A-5D are cross-sectional views of grid tees having pairs of conductors asymmetrically arranged with respect to the mid-plane of a respective grid tee.
Figure 5B:
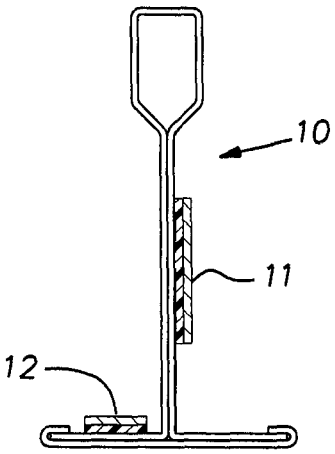
Figure 5C:
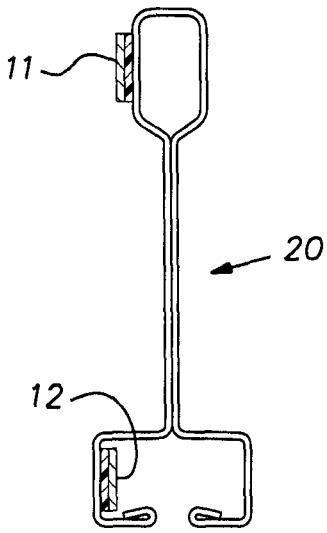
Figure 5D:
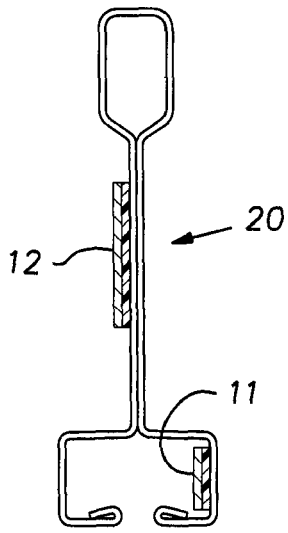

In FIG. 4A, discrete electrical conductors 11, 12 are fixed to the upper sides of a flange 13 of a grid runner or tee 10 of conventional cross-section. The numeral designation 10 will be used throughout the following disclosure when reference is made to a grid tee of standard configuration. As is customary, the structural body or mass of the tee 10 is roll-formed from metal sheet stock, typically steel. The tee cross-section includes an upper hollow reinforcing bulb 14 and a separate cap 16 folded at its edges over flange elements diverging from a double layer stem 18 extending up to the bulb 14, as is customary. The separate strips forming the tee proper and the cap can be prepainted or coated with a protective film before they are rolled to their finished shape. The conductors 11, 12 in this and other embodiments can take various forms including strips of conductive ink, metal foil, or tape of copper, brass, or aluminum, for example, or single or multi-strand wire running longitudinally with the length of the tee. The conductors 11, 12 are fixed to underlying areas of the tee with a suitable adhesive which may serve as an electrical insulator and prevent electrical contact between the conductor 12, 13 and tee 10. Alternatively, a separate electrically insulating medium may be applied to either the tee 10 or conductor 11, 12, apart from the adhesive medium therebetween. It is contemplated that the protective coating applied to the sheet material of the tee can serve as the requisite insulator. Still further, the exposed surfaces of the conductors 11, 12, i.e. those surfaces not facing the upper side of the flange 13 or other tee parts in other embodiments, can be covered with suitable insulating material to resist short circuiting against metal objects when a tee is installed in a ceiling structure. As depicted in FIGS. 4A-4E, the conductors 11, 12 can be situated in numerous locations. In FIGS. 4C-4E, the grid cross-section or profile is of the conventional downwardly open C-shaped channel type. In FIGS. 4C and 4E, the conductors are permanently placed in the hollow of the bottom channel against respective flat interior surfaces of the tee. In these latter figures, the tee is designated by the numeral 20.

Unless indicated differently, it will be understood that a conductor that is separate from a tee 10, 20, will be adhesively secured to the tee, or otherwise permanently affixed thereto, and will be electrically isolated therefrom.

As shown in FIGS. 5A-5D, the conductors 11, 12 can be arranged in asymmetrical patterns, when viewed along the longitudinal direction of a grid tee. Such arrangements can be used, for example, to assure proper assembly of grid elements and electrical connectors.

It is contemplated that any of the arrangements of FIG. 4 or FIG. 5 can be modified by eliminating one of the pair of conductors 11, 12, and by using the body of the tee 10 or 20 as the second conductor. Most commonly, the grid tees 10 or 20 will be formed of sheet steel, however, aluminum may be used and such aluminum may be extruded if not roll-formed. In the case of the two-piece tee 10, either the main body (that is, the upper flange elements 17, double layer stem 18, and bulb 14) or the cap 16, can constitute the conductor individually or collectively. Where an electrical connection is to be made to the tee 10 or 20 directly, the protective paint or coating applied to it will be locally omitted or removed to expose a conductive area. Where convenient or necessary, a brass or copper terminal can be attached to the conductive exposed area of the tee 10, 20.

Figure 6A:
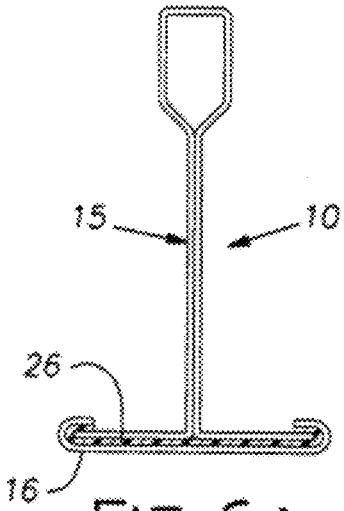
FIGS. 6A-6C are cross-sectional views of grid tees having parts of their bodies separated by an electrical insulator to form separate conductive circuit paths without additional conductors.
Figure 6B:
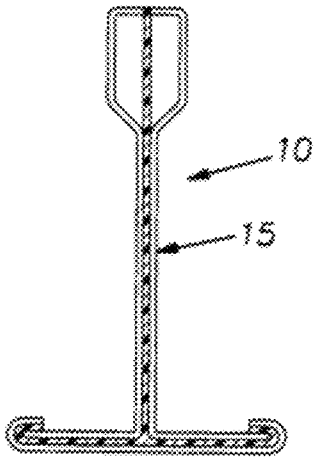
Figure 6C:
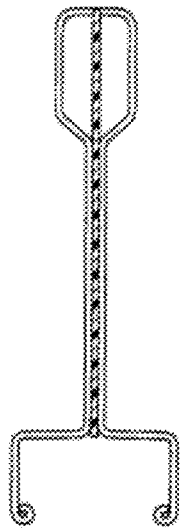

With reference to FIG. 6A, the grid tee cap 16 is isolated from a main body 15 of the tee 10 by insulating material 26 thereby allowing the cap to afford one conductive path or conductor and the main body 15 to provide the other conductive path or conductor. In FIG. 6B, the main body 15 is bisected by insulating material 26 so that the left and right sides of this tee element provide separate conductive paths or conductors.

Regarding the arrangement of FIG. 6A, either the body 15 or the cap 16 or both can be provided with a conductive trace of conductive ink, metal foil, or metal tape or wire. Such conductor can be electrically insulated from the respective body or cap element or can be in electrical contact with it to complement its current capacity.

It will be understood that suitable terminals, connectors, and the like will be attached to the various described grid tees conductor elements where lengths of grid tees are joined, and/or intersect and/or are tapped for power at a local electronic device, or are fed from a power supply.

It will be further understood that insulator layers can be coated or otherwise formed in situ or can be laminated to the respective tee element from roll stock, for example. Suitable insulating material is well known in the electrical arts. The conductive ink, in addition to using suitable metals, can employ electrically conductive non-metals including carbon.

Figure 7:
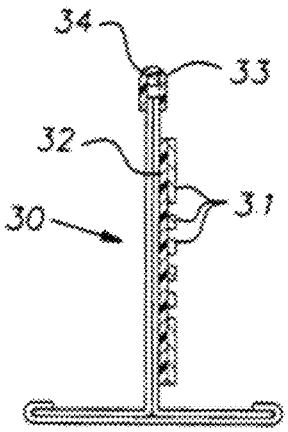
FIG. 7 is a cross-sectional view of a grid tee 30 having a multiplicity of conductors.

The grid tee 30 illustrated in FIG. 7 can be formed of rolled metal sheets and, in the illustrated case is without an upper reinforcing bulb. Alternatively, the tee 30 can be extruded of aluminum in one piece. The conductors 31 can be permanently affixed to a dielectric or insulator sheet 32 which is laminated or otherwise bonded to the stem of the tee 30. The conductors 31 can be copper or brass traces, each of adequate cross-sections to carry the expected currents independently of each other. A separate upper cap 33 can be made as an extrusion of suitable dielectric material such as polyvinylchloride which is extruded or molded around a conductor in the form of a wire 34. The conductor or wire 34 can serve as a common ground or source for the individual conductors 31. As discussed above, the conductors 31 can be fixed to the sheet stock forming the tee 30 before the stock is roll formed into the illustrated tee shape.

Figure 8:
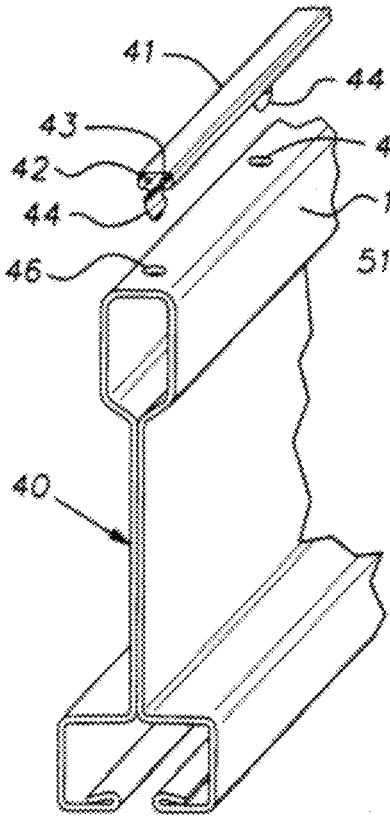
FIG. 8 is a fragmentary isometric view of a grid tee and separately formed insulator cap and wire assembly.

Referring to FIG. 8, a grid tee 40 has the general shape of the previously disclosed tee 20. An upper cap 41 is fixed on a reinforcing bulb 14 of the tee 40. The cap can be an extruded thermoplastic such as PVC or other electrical insulator. The upper cap contains a wire set 42, 43 providing electrification of the grid tee 40. The cap 41 can be mechanically attached to the bulb 14 of the grid tee 40 by inserting prongs 44 integrally molded on the cap into receiving apertures 46 and retained therein by a friction fit or an interference fit provided by a barb-like configuration in the prongs. It will be understood that the cap 41 or an equivalent can be provided with a single wire where the conductivity of the grid tee 40, itself, is utilized or can be provided with a multiplicity of wires.

Figure 9:
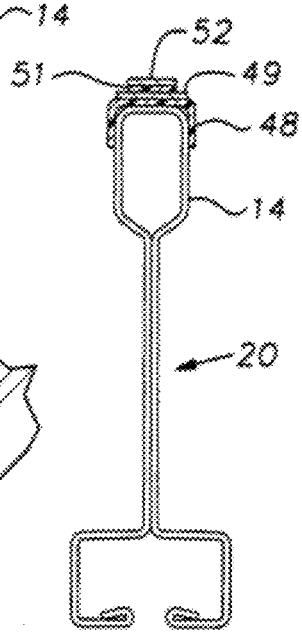
FIG. 9 is cross-sectional view of a grid tee fitted with an assembly of conductive and non-conductive layers.

In FIG. 9, there is shown a grid tee having an elongated plastic bar 48 secured to the bulb 14 such as by a pressure sensitive adhesive. Typically, the bar is applied after the grid tee 10 is formed. As an alternative to adhesive fixing of the bar 48 to the tee 10, the bar, as shown, can have a channel or C-shaped cross-section with legs fitting over the bulb 14. On an upper surface of the bar 48 can be coated a conductive ink 49 to provide a conductor. If desired, an insulating layer 51 can be applied to the ink layer 49 and, in turn, a second ink layer 52 can be applied to the upper side of the insulating layer 51. The reduced width of the upper conductive layer 52 and the underlying insulating layer 51 provides accessibility to the lower conductive layer 49 for suitably formed connectors for supplying or utilizing electrical power. The plastic bar 48 along with the various conductive and insulating layers 49, 51, 52, can be applied to the tee 10 in the factory after the tee is rolled or otherwise fabricated or can be applied in the field before or after the grid is installed.

Figure 1:
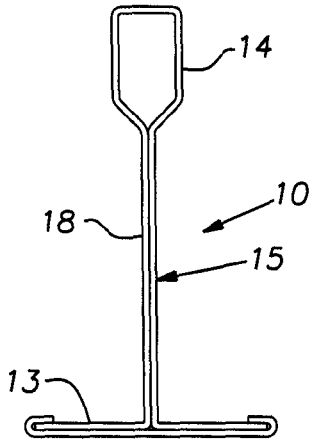
FIG. 1 PRIOR ART
FIG. 1 is a cross-sectional view of a conventional grid tee.
Figure 2:
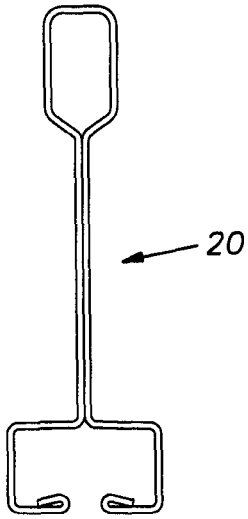
FIG. 2 PRIOR ART
FIG. 2 is a cross-sectional view of a conventional modified form of grid tee.
Figure 3:
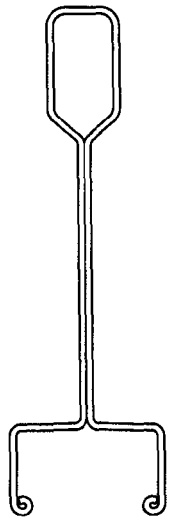
FIG. 3 is a cross-sectional view of a novel modified form of grid tee useful in providing an electrified grid according to the invention.
Figure 10:
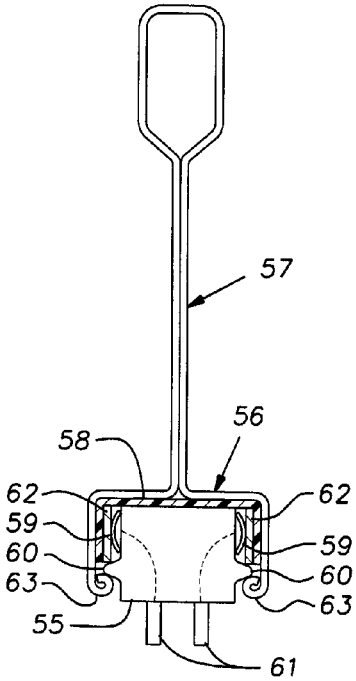
FIG. 10 is a view similar to FIG. 3 including a diagrammatic showing of a connector assembly.

FIG. 10 illustrates an elongated insert assembly 56 proportioned to snap into the novel grid tee 57 shown in FIG. 3. The insert 56 which runs the full length of the tee 57 includes an insulating channel 58 including a web and legs. Permanently attached to the opposed legs are associated opposed conductors 62. The conductors 62 can comprise any of the foregoing described conductor compositions. The legs are proportioned to be frictionally held or mechanically captured within the interior of the depending channel formed by the flange of the tee 57. More particularly, hems 63 formed by folded-in edges of the sheet stock forming the tee 57 underlie the distal edges of the legs so as to mechanically capture the insert 56 within the tee channel. A connector block 55, preferably molded of a suitable plastic is proportioned to snap into the lower channel or slot of the tee 57. The block 55 includes a pair of opposite rounded projections 60 sized to fit in the channel and be retained therein by the hems 63. Spring-like metal blade contacts 59 engage respective conductors 62 to transfer power to or from the conductors. Leads 61 connect the blade contacts 59 to external electric devices which can be integrated with or supported by the block 55.

Figure 11:
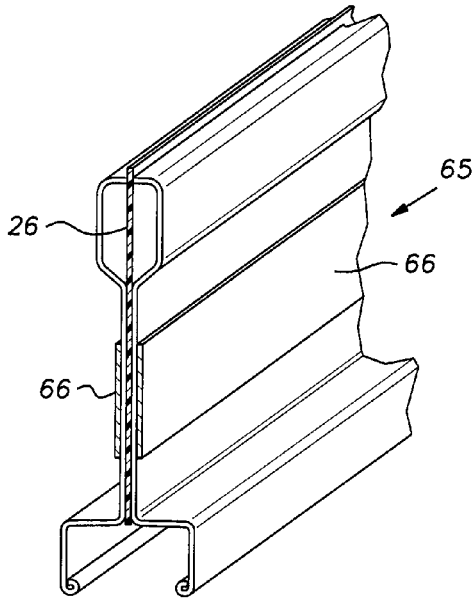
FIG. 11 is a fragmentary isometric view of a grid tee similar to that shown in FIG. 6C.

In FIG. 11, a tee 65 analogous to the tee 20 is split at its mid-plane with the left and right sides being isolated from one another by insulating material 26. One or both halves of the tee 65 can be provided with conductors 66. The conductors 66 can be electrically connected to their respective tee halves or can be electrically insulated from such associated halves. Where no separate conductor 66 is provided, the tee half can provide a conductive path for electrical power.

Figure 12:
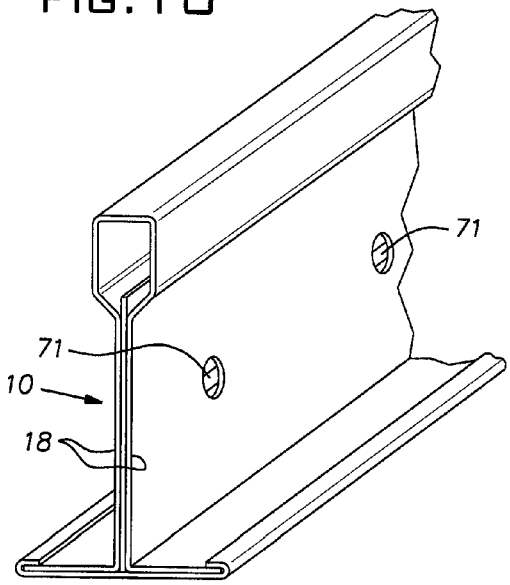
FIG. 12 is a cross-sectional view of a grid tee with a conductive path within the web or stem of the tee.

Referring now to FIG. 12, a tee 10 can be provided with a conductor in the form of a printed ink trace 71 or a conductive foil, tape, or bar. The conductor 71 can be applied to one of the layers 18 of the web with an insulator layer between it and each of the web layers. Typically, this can be done while the strip forming the tee 10 is flat. The sheet area forming the interior of the tee is first coated with an insulating layer, then the conductor layer such as the referenced conductive ink, and then an overcoat insulator layer. One or both of the stem or web layers 18 can be perforated during the tee forming process to provide access to the conductor 71.

Figure 13:
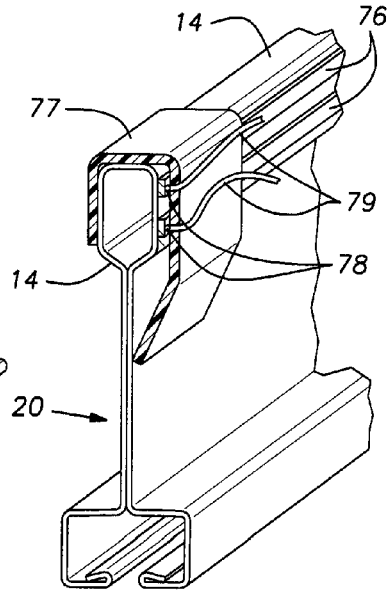
FIG. 13 is a diagrammatic representation of a cross-section of a grid tee having conductive ink traces and a clip used to establish a connection to feed or draw power from such traces.

With reference to FIG. 13, two conductive ink traces 76 are formed over electrically insulated areas of the bulb 14 of a tee 20. A plastic electrically insulating clip 77 maintains electrical contacts 78 against the pair of traces 76. The contacts 78 have wire leads 79 adapted to feed power to the traces 76 or to draw power from the same.

Figure 14:
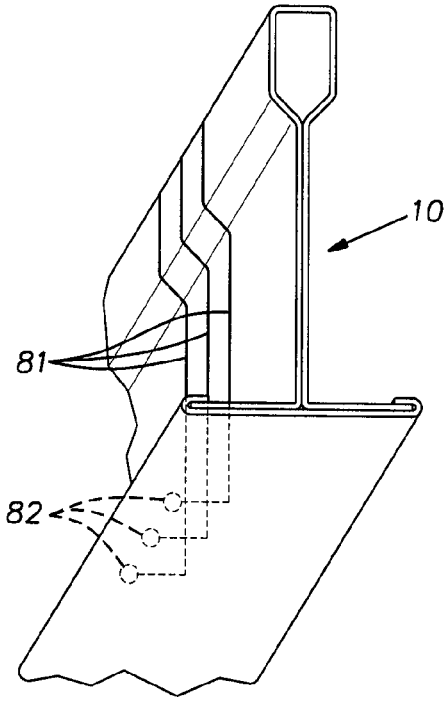
FIG. 14 illustrates a grid tee with conductors running vertically on a grid tee.

Referring to FIG. 14, a tee 10 has one or more conductors 81 running vertically from the top of the bulb 14 to the lower flange 13. The conductors 81 can, for example, be printed with conductive ink over suitable insulating layers. In appropriate circumstances, the flange 13 can be provided with apertures 82 through which the conductors 81 may be accessed from the lower face of the flange 13.

Figure 15:
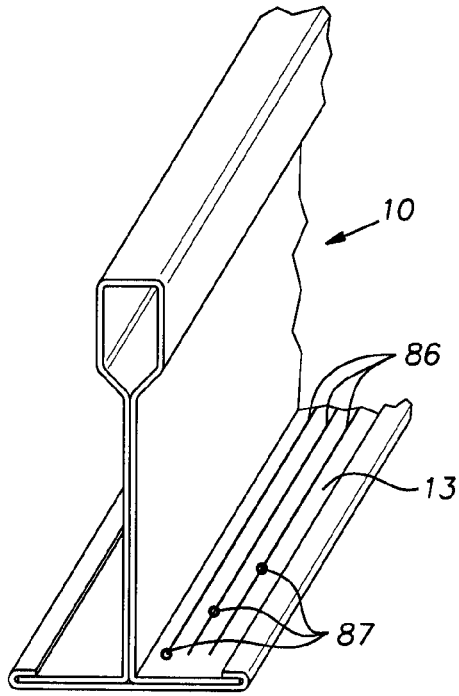
FIG. 15 is a fragmentary isometric view of a grid tee 10 having multiple easily tapped conductors.

FIG. 15 illustrates a tee 10 on which a plurality of conductors 86 are printed or otherwise established on the upper side of the flange 13. The conductors 86 are isolated from one another and are isolated from the flange by an insulating layer applied to the top surface of the flange 13. Additionally, the conductors 86 are over-coated with an insulating layer to avoid short circuiting. The over-coating of the top insulating layer may be omitted at points 87 to facilitate connection with electrical contacts or electrical wires.

Figure 16:
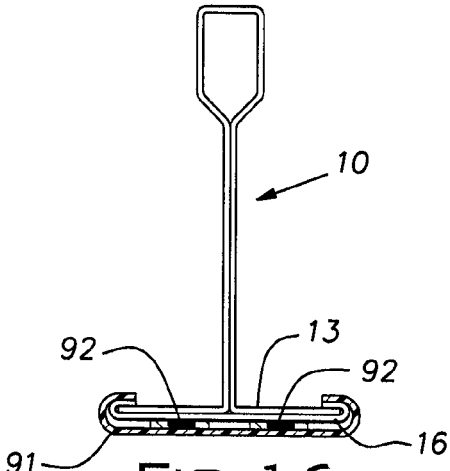
FIG. 16 illustrates a grid tee with a flange over-cap carrying conductive traces.

Making reference to FIG. 16, a conventional grid tee 10 can be fitted with a cap 91 after the grid tee is installed. The cap can be made of plastic or metal suitably coated with an insulating layer on its interior. The cap 91 is printed with a conductive ink to form one or more conductors. The conductors 92 are over-coated with an insulating material to prevent shorting against surfaces or edges of the tee 10. Alternatively, the cap 91 can be structured such that when it is installed, the conductor or conductors are spaced away from the lower surface of the flange 13 or cap 16. By temporarily removing the cap 91, the conductors 92 are readily accessible for establishing a circuit with a connector for supplying or drawing power.

Figure 17:
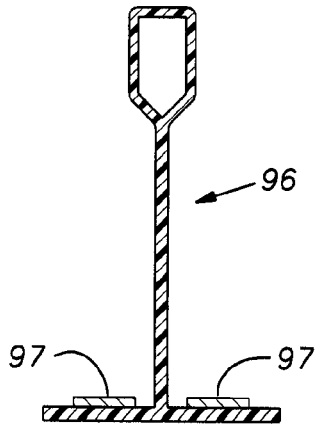
FIG. 17 illustrates a grid tee made of electrically insulating material.

FIG. 17 illustrates a novel grid tee 96 which is extruded or otherwise formed of electrically insulating material such as PVC or other well-known thermoplastic or thermosetting material. Conductors 97 are attached to any of those surface locations as previously described and preferably on non-visible surfaces of the tee 96. Since the tee 96 is electrically insulating, there is no requirement that the conductors be insulated from the tee and can be directly attached to the same by any suitable expedient such as adhesive or mechanical interlocking.

The foregoing tee constructions and electrification of the same can deliver power to various devices carried over, in or under the plane of a ceiling. Such devices while drawing power from the grid electrification, can communicate to other nearby or remote devices with radiofrequency signaling.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. An elongated grid tee, with a reinforcing bulb at its upper side, for supplying low voltage power on a suspended ceiling comprising at least two electrically conductive paths electrically insulated from each other, extending lengthwise of the tee, and accessible for receiving or supplying electrical power at numerous locations along the length of the tee, at least one of the electrically conductive paths being disposed in an elongated plastic insulator cap mechanically attached to the bulb with prongs, the prongs extending from the plastic insulator cap and inserted and retained in receiving apertures in the bulb.

2. A grid tee as set forth in claim 1, wherein the conductive paths are symmetrically disposed on the tee relative to a central plane of symmetry of the tee.

3. A grid tee as set forth in claim 1, wherein the at least two electrically conductive paths are made of wire and are disposed in the plastic insulator cap.

4. A grid tee as set forth in claim 1, wherein the prongs are integral with the plastic insulator cap.

5. A grid tee as set forth in claim 1, wherein the prongs have barb-like configurations.

* * * * *